US006325237B1

(12) United States Patent
Gish

(10) Patent No.: US 6,325,237 B1
(45) Date of Patent: Dec. 4, 2001

(54) DEVICE FOR ASSISTING A BABY AND THOSE WITH DISABILITIES IN HOLDING A BOTTLE

(76) Inventor: Barbara A. Gish, 8724 Northwest 10th St., Plantation, FL (US) 33322

( * ) Notice: Subject to any disclaimer, the term of this patent is extended or adjusted under 35 U.S.C. 154(b) by 0 days.

(21) Appl. No.: 09/695,475

(22) Filed: Oct. 24, 2000

(51) Int. Cl.[7] ..... B65D 25/28
(52) U.S. Cl. ..... 220/737; 220/758
(58) Field of Search ..... 220/737, 758, 220/772

(56) References Cited

U.S. PATENT DOCUMENTS

| | | | | |
|---|---|---|---|---|
| D. 289,721 | * | 5/1987 | Havis | D7/622 |
| D. 414,687 | * | 10/1999 | Rivera | D9/319 |
| 1,640,004 | * | 8/1927 | Lundblad . | |
| 2,637,515 | | 5/1953 | Walsh . | |
| 2,789,002 | | 4/1957 | Nicholas . | |
| 3,718,360 | | 2/1973 | Knutzen . | |
| 4,414,692 | * | 11/1983 | Dzierson et al. | 2/160 |
| 4,557,392 | | 12/1985 | Ryan et al. . | |
| 4,941,579 | * | 7/1990 | Lee | 215/11.1 |
| 4,943,017 | | 7/1990 | Ennis . | |
| 5,072,843 | | 12/1991 | James . | |
| 5,480,043 | | 1/1996 | Wingo . | |
| 5,671,864 | * | 9/1997 | Caruthers | 220/737 |
| 6,000,058 | * | 12/1999 | Iselin | 2/160 |

* cited by examiner

*Primary Examiner*—Stephen Castellano
(74) *Attorney, Agent, or Firm*—Amster, Rothstein & Ebenstein

(57) ABSTRACT

A bottle holder to attach gloves such as mittens to a bottle for helping babies or those with disabilities to hold and use the bottle. The bottle holder attaches at least one glove to the outside of a bottle to hold the bottle in place relative to the wearer of the glove. The gloves may be attached to a central flexible band which is stretched around the outside of the bottle, or may be connected individually by adhesive or other fastening means. The device reduces the gripping force needed to hold a bottle and is therefore suited to infants and invalids who may not be able to sustain the strength needed to hold the bottle.

8 Claims, 2 Drawing Sheets

DEVICE FOR ASSISTING A BABY AND THOSE WITH DISABILITIES IN HOLDING A BOTTLE

The present invention relates generally to a device for assisting in holding a bottle, and more specifically to a device for attaching gloves such as mittens to a bottle to permit the bottle to be held in place by the user.

BACKGROUND OF THE INVENTION

Many attempts have been made to resolve the familiar problem in which a baby's hands are too small to properly hold a bottle. Among adults, it may also be the case that due to various physical disabilities, it may be difficult to properly hold a bottle, especially one that may be filled with liquid. One known approach has been to fasten various handles to the bottle. U.S. Pat. No. 5,480,043 to Wingo discloses a two-handle collar wherein the handles are of a size and arranged at an angle to facilitate holding of the bottle by the small hands of an infant. Similarly, U.S. Pat. No. 4,943,017 to Ennis provides a pair of handles at either end of an elastic band wherein the band is designed to be stretched around the circumference of a bottle thereby securing the two handles to the outside of the bottle, making it easier for small or disabled hands to hold.

Although the prior art facilitates the use of a bottle by adapting the means for gripping it, the bottle may still be difficult to hold. Regardless of its shape, angle and design, any handle must still be gripped by its user in order to be effective. In the case of an infant, a baby's hands may not be sufficiently strong or the baby may not yet have developed sufficient manual dexterity to grip the handles of the bottle for an extended period of time. The result is that even those bottles equipped as known in the prior art are likely to be dropped frequently, frustrating attempts to train the baby to feed itself. Similarly, an invalid may not be able to hold a handle at all depending on the nature of the disability.

As a result, there still remains a need for a device to make a bottle easier to hold for an infant and for those with a wide range of disabilities.

SUMMARY OF THE INVENTION

The present invention discloses a bottle holder in which at least one glove is attached to a fastening means which is adapted to receive and hold a bottle. Thus, the bottle holder functions to hold the bottle and glove in place relative to one another enabling the wearer of the glove easily to hold the bottle.

In a first embodiment of the present invention a single glove such as a mitten is connected to the attachment means, which may be an annular flexible band. In this embodiment the annular band has sufficient resiliency to expand to except a bottle and to removably hold itself and the attached mitten in place relative to it. A single hand inserted into the mitten is sufficient to hold the bottle in place relative to the hand.

In a second embodiment a pair of gloves or mittens is attached to the annular band in approximately opposing positions. When the annular band is disposed about a bottle in a manner similar to the first embodiment, the invention permits two hands to be inserted into the gloves to secure the bottle.

In a third embodiment, gloves are integrated with a bottle such that the gloves are connected directly to the bottle or are an integral part thereof.

Because the gloves tend to hold the hands in place without a need to grip a handle, and because the gloves may be oriented to permit the hand to assume a normal relaxed orientation, a relatively heavy bottle filled with liquid may be held with ease for extended periods by those who may need assistance in the holding of a bottle.

DETAILED DESCRIPTION OF THE INVENTION

Figure 1:
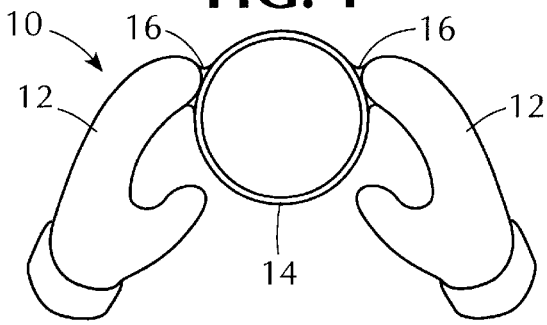
FIG. 1 is a top view showing the profile of the bottle holder of the present invention.

FIG. 1 shows an embodiment of the present invention wherein gloves 12, 12 which may be a pair of ordinary gloves or, as illustrated, a pair of mittens attached to opposite sides of securement 14, shown as an annular band. Glove 12 must admit a hand and must conform in such a way to the shape of the hand as to generally remain in place relative to the hand. Gloves and mittens having these characteristics are commonly available and produced in a variety of sizes and materials. The gloves 12, 12 are each fastened to securement 14 at a connection point 16. Securement 14 may be formed of a resilient material such as rubber and should be of sufficient diameter to admit a bottle (not shown) thereby to secure the gloves to the bottle. Alternatively, securement 14 may be made of a rigid material and may form a sleeve having a shape corresponding to a specific bottle. Alternatively, only a single glove may be used for the same applications.

Figure 2:
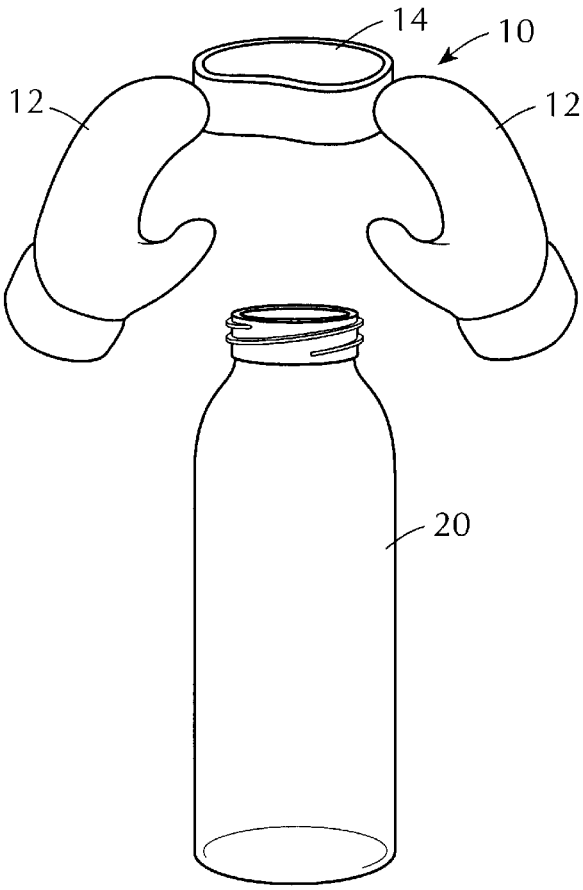
FIG. 2 is a side view showing the bottle holder of the present invention being utilized with a cylindrical fluid container.

FIG. 2 shows bottle holder 10 positioned above bottle 20 in the preferred orientation for attachment thereto. As shown, securement 14 functions primarily to removably hold the attached gloves 12 to the bottle 20. Therefore, securement 14 may simply be a discreet fastener such as a suction cup, magnet, snap connection or "velcro" strip attached at a connection point directly to each glove 12 and to the bottle, with the same result as achieved with an annular band shown.

Figure 3:
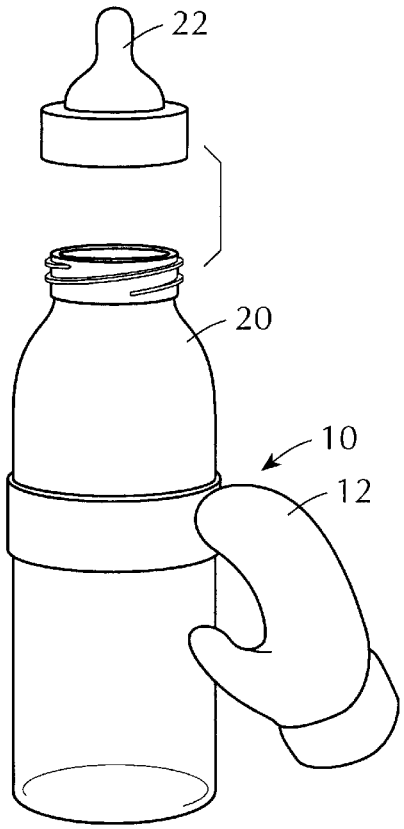
FIG. 3 is a side view of an embodiment of the present invention being utilized with a cylindrical fluid container having a nipple.

FIG. 3 shows an embodiment of bottle holder 10 wherein a single glove 12, illustrated as a single mitten, in position on bottle 20. Nipple 22 is shown detached from bottle 20 to which it may be attached.

Figure 4:
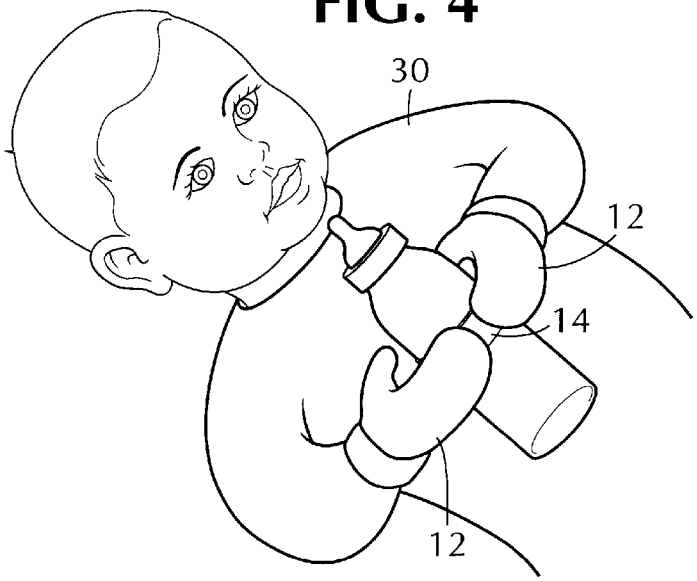
FIG. 4 is a top view showing a device of the present invention as it may be used by an infant.

FIG. 4 shows the bottle holder in use, in this case by an infant in holding a baby bottle. Infant 30 is shown with hands inserted into gloves 12 which are attached to the bottle by securement 14 in an orientation that permits infant 30 to maintain a natural comfortable posture while the bottle is held in place relative the infant's hands.

In this embodiment, it is not necessary for infant 30 to exert significant grasping force on said bottle in order for it to be held in place. Gloves 12 form a natural receptacle for an infant's hands that tends to avoid inadvertent disengagement. However, depending on the type of glove, and the flexibility of securement 14, limited movement of the infant's hands relative to one another is possible, and the entire device may be removed without injury to the infant in the event that an abrupt force shakes the bottle loose. Furthermore, gloves 12 may be shaped as mittens of various sizes to accommodate different size hands and may be formed of comfortable elastic material or may be colored as for example baby-blue or pink.

Figure 5:
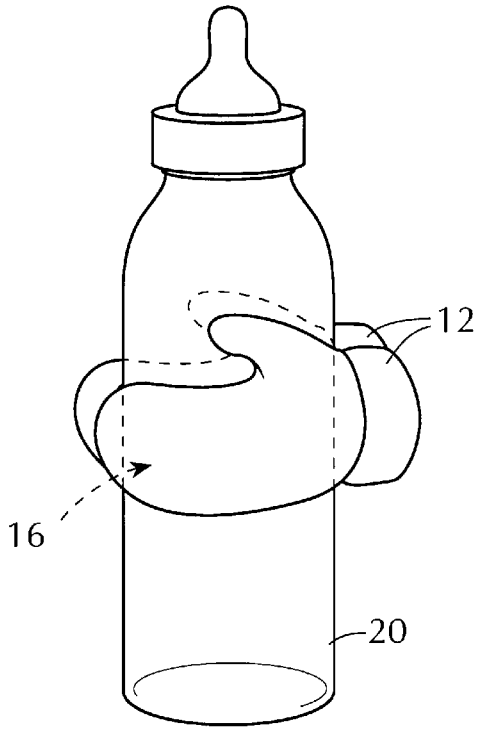
FIG. 5 is a side view of an embodiment of the present invention.

FIG. 5 shows an embodiment of the present invention wherein gloves 12 are integrated with the structure of bottle 20. In this embodiment, the glove means 12 is not removable, although connection point 16 may provide a flexible connection between glove means 12 and bottle 20. Therefore, in this embodiment glove means 12 are ideally constructed of a waterproof or washable material such as latex or nylon to permit bottle 20 to be washed with the gloves attached.

As changes and modifications to the specific embodiments disclosed herein necessary to conform to specific circumstances may be recognized by those skilled in the art, the invention is not considered limited to the illustrative examples chosen for purposes of description. Rather, the invention is considered to include all changes and modifications which do not constitute a departure from the true spirit and scope of the invention as claimed in the following claims and equivalents thereto.

What is claimed is:

1. A bottle holder to assist an infant in the holding of a bottle comprising:

a securing means removably attachable to said bottle; and two glove-like structures flexibly attached to said securing means, each having an exterior surface defining an interior receptacle and an opening in said exterior surface suitable for removably admitting and retaining the hands of said infant within said receptacles;

whereby said bottle is held in place by said hands without significant gripping force applied to said bottle holder by said infant.

2. The bottle holder of claim 1 wherein said securing means comprises a flexible annular band attached to said two glove-like structures and adapted to fit securely around said bottle.

3. The bottle holder of claim 2 comprising two glove-like structures attached on opposite sides to said securing means and oriented to simultaneously admit two hands of said infant.

4. The bottle holder of claim 1 wherein said securing means is attached to said two glove-like structures at the exterior surface thereof.

5. The bottle holder of claim 1 wherein at least one of said interior receptacles comprises a separate, contiguous chamber for a thumb of said hand.

6. A bottle holder to assist an infant in the holding of a bottle comprising:

a generally cylindrical band that is flexible and removably attachable to said bottle; and two spaced-apart glove-like structures each separately and flexibly attached to different portions of said cylindrical band, each of said glove-like structures having an exterior surface defining an interior chamber, and an opening in said exterior surface adapted to admit and retain a hand of said infant within said chamber;

whereby said bottle is held in place relative to said hand.

7. The bottle holder of claim 6 wherein said interior receptacle comprises a separate, contiguous chamber for a thumb of said hand.

8. The bottle holder of claim 6 comprising two glove-like structures attached to said securing means and oriented to admit simultaneously both hands of said infant.

* * * * *